US007419327B2

(12) United States Patent
Weiss, Jr.

(10) Patent No.: US 7,419,327 B2
(45) Date of Patent: Sep. 2, 2008

(54) METHOD FOR FABRICATING AND EMPLOYING A PAVING SYSTEM USING ARRAYS OF VERTICALLY INTERLOCKING PAVING BLOCKS

(75) Inventor: Charles A. Weiss, Jr., Clinton, MS (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 153 days.

(21) Appl. No.: 11/603,431

(22) Filed: Nov. 22, 2006

(65) Prior Publication Data

US 2008/0118307 A1 May 22, 2008

(51) Int. Cl.
*E01C 5/00* (2006.01)

(52) U.S. Cl. ..... 404/73; 404/72

(58) Field of Classification Search ..... 404/72, 404/73

See application file for complete search history.

(56) References Cited

U.S. PATENT DOCUMENTS

| | | | |
|---|---|---|---|
| 519,873 | A | 5/1894 | Pope |
| 1,186,673 | A | 6/1916 | Mallet |
| 1,660,459 | A | 2/1928 | Graham |
| 2,703,487 | A | 3/1955 | Ossoinack |
| 3,305,982 | A | 2/1967 | Steele |
| 3,495,367 | A | 2/1970 | Kobayashi |
| 3,795,079 | A | 3/1974 | Klem |
| D251,510 | S | 4/1979 | Schuring |
| 4,382,046 | A | 5/1983 | Frohwerk |
| 4,436,779 | A | 3/1984 | Menconi et al. |
| 4,612,554 | A | 9/1986 | Poleshuk |
| 4,681,481 | A | 7/1987 | Kapusta |
| 4,745,715 | A | 5/1988 | Hardwicke et al. |
| 5,054,253 | A | 10/1991 | Bedics |
| 5,111,627 | A | 5/1992 | Brown |
| 5,277,514 | A | 1/1994 | Glickman |
| 5,409,325 | A | 4/1995 | Wu |
| 5,429,451 | A | 7/1995 | Pettee |
| 5,496,129 | A | 3/1996 | Dube |
| 5,556,228 | A | 9/1996 | Smith |
| 5,647,185 | A | 7/1997 | Forlini |
| 5,685,666 | A | 11/1997 | Marshall et al. |

(Continued)

FOREIGN PATENT DOCUMENTS

| | | |
|---|---|---|
| DE | 4013029 | 10/1991 |

(Continued)

*Primary Examiner*—Raymond W Addie
(74) *Attorney, Agent, or Firm*—Earl H. Baugher, Jr.

(57) ABSTRACT

A method for fabricating and forming a continuous covered area, such as a sidewalk or patio, employing vertically interlocking tessellated components. One embodiment, termed PORTAPAVE™, achieves this interlocking via an array of uniquely configured two-sectioned pavers. Each paver has a first section of a first shape and a second section of a second shape impressed upon the first section and bonded together. In one embodiment, first sections of pavers are installed in a bottom layer to form a cavity between them having the same shape as the second section of a paver that is inverted onto the pavers of the bottom layer, thus providing a top layer. Each inverted paver in this top layer is fitted to interlock in that cavity formed between the un-inverted pavers in the bottom layer.

17 Claims, 9 Drawing Sheets

U.S. PATENT DOCUMENTS

| | | | |
|---|---|---|---|
| 5,779,391 | A | 7/1998 | Knight |
| 5,787,637 | A | 8/1998 | Keen |
| 5,787,666 | A | 8/1998 | Sherry |
| 5,890,836 | A | 4/1999 | Leech |
| 6,036,402 | A | 3/2000 | Meldrum et al. |
| 6,071,041 | A | 6/2000 | Knight |
| 6,079,902 | A | 6/2000 | Pettee |
| 6,379,079 | B1 | 4/2002 | Camomilla |
| 6,508,607 | B1 | 1/2003 | Smith et al. |
| 6,551,016 | B2 | 4/2003 | Guidon |
| 6,739,797 | B1 | 5/2004 | Schneider |
| 7,160,052 | B2 * | 1/2007 | Weiss et al. ..... 404/34 |

FOREIGN PATENT DOCUMENTS

| | | |
|---|---|---|
| FR | 2737229 | 1/1997 |
| GB | 2075571 | 11/1981 |
| GB | 2113741 | 8/1983 |
| GB | 2283996 | 5/1995 |
| WO | WO 9905370 | 2/1999 |

* cited by examiner

METHOD FOR FABRICATING AND EMPLOYING A PAVING SYSTEM USING ARRAYS OF VERTICALLY INTERLOCKING PAVING BLOCKS

STATEMENT OF GOVERNMENT INTEREST

Under paragraph 1(a) of Executive Order 10,096, the conditions under which this invention was made entitle the Government of the United States, as represented by the Secretary of the Army, to the entire right, title and interest therein of any patent granted thereon by the United States. This patent and related ones are available for licensing. Contact Phillip Stewart at 601 634-4113.

RELATED APPLICATIONS

This application claims the benefit of prior co-pending U.S. patent application Ser. No. 10/923,889, Paving System Using Arrays of Vertically Interlocking Paving Blocks, by Weiss et al., filed Aug. 24, 2004, incorporated herein by reference.

BACKGROUND

Heretofore, providing a lateral attachment between laterally adjacent elements in a paving system has been a problem. U.S. Pat. No. 5,054,253, Rigid Grating Mat with Unidirectional Elements, to Bedics, Oct. 8, 1991, describes a system for building a mat that has separate plank-like elements that are joined laterally by a tongue and groove construction. This makes for a complicated extrusion that is difficult to construct and is easily extended laterally only in one direction.

U.S. Pat. No. 5,429,451, Grid Matrix System Including Interconnected Revetment Blocks, to Pettee, Jul. 4, 1995, describes a grid matrix system that has interconnected revetment blocks. These square or hexagonal blocks have alternate recesses and locking protrusions (or ears). A disadvantage of this construction is that it can be easily vandalized because the individual blocks or elements can be lifted vertically. Further, casting the units in concrete presents problems because the ears and edges of the locking recesses can be relatively easily broken.

DETAILED DESCRIPTION

Figure 1B:
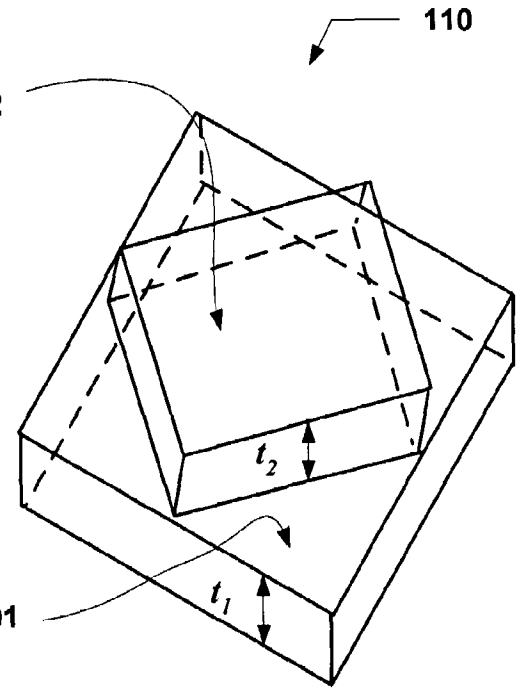
FIG. 1B depicts a perspective view of a single unit used in the array of FIG. 1.

Embodiments of the present invention comprise in part employing a component having a first section with first sides parallel to a first plane containing a first bearing surface and a first thickness in a second plane orthogonal to the first plane, the first thickness of a dimension less than that of any of the first sides and a second section having second sides parallel to both the first plane and a second plane containing a second bearing surface, the second plane parallel to the first plane, the second section contacting the first section uniformly along a part of the first plane, the second section oriented to the first section such that the second sides are contained entirely within the perimeter formed by the first sides.

One embodiment employs a component having the first sides form a first square and the second sides form a second square set at about a 45° angle to the first square, the second square having sides of a length approximately 0.707 that of the first sides.

Another embodiment employs a component having the first sides form a hexagon and the second sides form a diamond with the long axis of the diamond extending in a line joining the center of two parallel sides of the hexagon and the short axis of the diamond chosen to be the same width as that formed by two parallel first sides of the hexagon.

Another embodiment employs a component having the first sides form a square and the second sides form a single right triangle along two adjacent sides of the square.

In select embodiments of the present invention, employed components may have first and second sections fabricated such that the first and second sections are incorporated inseparably in the component. In select embodiments of the present invention, employed components may have at least one of the first and second sections formed of a lamination of at least two layers. In select embodiments of the present invention, employed components may have at least one of the layers made of a material flexible under compression.

An embodiment of the present invention may employ an array of any of the components above comprising a first set of four components, each component arranged in a plane to abut a first component along a first axis in that plane and a second component arranged along a second axis in that plane, the second axis orthogonal to the first axis, and a second set of four components arranged as above, the second four components inverted and arranged to interlock vertically with the first four components.

In select embodiments of the present invention, a configuration of arrays as above may be employed as a plurality of the arrays abutting one to another and arranged to cover a prespecified area. In select embodiments of the present invention, the above configuration further may be employed as partial components for forming finished edges of the configuration, such as a component cut in half.

In select embodiments of the present invention, employed configurations may be arranged to form a pathway.

In select embodiments of the present invention, employed arrays may be joined by flexible means incorporated between the first and second sections during fabrication and extending in a plane approximately parallel to each of the first and second sections so as to permanently connect and position each of the four components in an array. The flexible means may employ material selected from the group consisting essentially of a mesh, a fabric, roving, a web-perforated fabric, a wire mesh, an elastomer, and combinations thereof.

In select embodiments of the present invention, a plurality of employed connected arrays abutting one to another may be arranged to cover a pre-specified area, such a road or pathway. In select embodiments of the present invention, employed configurations may comprise partial components, such as components cut in half, for forming finished edges of the configuration, e.g., a road or pathway.

Select embodiments of the present invention provide a method for covering a pre-specified area, comprising leveling the pre-specified area; arranging any of the employed components as described above in an array as described above, abutting a number of arrays to cover the pre-specified area in a first plane, and inverting a second configuration of pre-specified like arrays over the first configuration such that the second configuration interlocks vertically with the first configuration and adding partial components, such as components cut in half, for forming finished edges of the interlocked configurations.

In select embodiments of the present invention, a method employs components comprising first sides forming a first square, second sides forming a second square set at about a 45° angle to the first square, the second square having sides of a length approximately .707 that of the first sides.

In select embodiments of the present invention, a method employs components comprising first sides forming a hexagon and second sides forming a diamond with the long axis of the diamond extending in a line joining the center of two parallel sides of the hexagon and the short axis of the diamond chosen to be the same width as that formed by two parallel first sides of the hexagon.

In select embodiments of the present invention, a method employs components comprising first sides forming a square and second sides forming a single right triangle along two adjacent sides of the square.

In select embodiments of the present invention, a method employs a component comprising first and second sections fabricated such that the first and second sections are incorporated inseparably in the employed component.

In select embodiments of the present invention, a method employs a component in which at least one of the first and second sections is formed of a lamination of at least two layers. In select embodiments of the present invention, at least one of the layers may be constructed of a material flexible under compression.

Select embodiments of the present invention provide a method of fabricating components for a vertically interlocking configuration, comprising providing a first mold to form a first section as described above, providing a second mold to form a second section as described above; pouring a fluid mixture of a first material into the first mold to be at least partially hardened in the mold as the first section; permitting the first mixture to at least partially harden in the first mold; placing a second mold over the first at least partially hardened mixture in a pre-specified orientation; pouring a fluid mixture of a second material into the second mold to be hardened in the mold; upon hardening of the first and second mixtures to a pre-specified level, removing both molds and trimming the component as necessary.

In select embodiments of the present invention, the above method of fabricating may also comprise arranging at least four like components in a pre-specified array and adding a connecting means over at least a portion of each of the first sections of each before placing the second mold so that the connecting means is embedded in each component, both connecting and orienting the components in an array. The employed connecting means may comprise material selected from the group consisting essentially of a mesh, a fabric, roving, a web-perforated fabric, a wire mesh, an elastomer, and combinations thereof. In select embodiments of the present invention, fabrication may employ the same material for the first and second sections.

In select embodiments of the present invention, the employed sections may be a mixture containing at least some Portland cement. In select embodiments of the present invention, a method may employ different materials for fabricating the first and second sections. In select embodiments of the present invention, a method of fabrication may employ layers of different materials for at least one of the first and second sections such that at least one of the first and second sections is a laminate of at least two layers. In select embodiments of the present invention, at least one material flexible in compression may be employed in at least one of the layers.

Select embodiments of the present invention may be employed to form a continuous paved traffic way without having to laterally interlock a paving block with its neighbor. One employed embodiment, suitable for quickly forming a pavement, is termed PORTAPAVE™.

This is achieved in one aspect by employing a paving mat that comprises an array of paving blocks, and means for connecting the paving blocks together in the array. Each paving block includes a bottom part having a first shape, and a top part having a second shape. Neighboring top parts of blocks form a cavity between them having the same shape as the top part of a block so that a second similar array of paving blocks can be turned upside down and overlapped and interlocked with the first array of paving blocks to make a two-layered block paving unit.

Also provided in an embodiment of the present invention is a method of making a paving mat that comprises: providing a first array of the above described paving blocks and providing means for connecting the paving blocks together in the array. In one embodiment, since neighboring top parts of blocks form a cavity between them having the same shape as the convex top part of a block, in one method a second similar array of paving blocks is turned upside down, thus overlapping and interlocking with the first array of paving blocks to make a two-layered block paving unit.

Embodiments of the present invention, unlike conventional "articulated concrete mats," employ overlapping vertically interlocking arrays thus maintaining integrity of the mat. In one embodiment, placement of the employed blocks involves staggering the positions of the blocks so that a block in an upper layer partly covers the intersection of the contacting blocks in the lower layer. This reduces the chance for vegetation to grow through the paving unit. In one embodiment the means for connecting the employed paving blocks together in an array is an opaque material, such as a fabric or an elastomer. This opaque material blocks light and either kills vegetation or confines it.

In one embodiment runoff water can be controlled by inserting a mesh fabric between layers or providing drain holes in the connecting means. In one embodiment, employed paving units may be moved by lifting upper layers (mats), so that the lower layers (mats) may be separated. In embodiments to be installed permanently, a layer of mortar may be spread over the lower layer and the upper layers bonded thereto. Embodiments of the present invention may facilitate a change in the direction of the pavement by staggering the employed layers (mats) laterally so the track "curves" as needed.

Embodiments of the present invention employ arrays of vertically interlocking units that may be employed in applications otherwise suitable for conventional individual paving blocks. In embodiments of the present invention, the employed connecting means prevent individual blocks from moving laterally. In conventional systems this is accomplished by attaching the connecting means from one array of blocks to adjacent arrays. A cavity formed between neighboring top parts of the un-inverted units has the same shape as a unit's top section so that a second similar array of units may be inverted and interlocked with the un-inverted array to make a two-layered paving mat, for example. Thus, in embodiments of the present invention, interlocking an un-inverted array with an inverted array of units obviates the need for any "holding" means.

In embodiments of the present invention, arrays of vertically interlocking units may be employed as "portable" pathways, e.g., pedestrian or vehicle thoroughfares that may be temporary or permanent. Embodiments of the present invention may also be employed on fords where it is necessary to anchor the units on a slope. Embodiments of the present invention may also be used to prevent stream bank erosion, as a base for a waterproof liner, or as a weed-free break to limit or control grass fires.

Figure 1A:
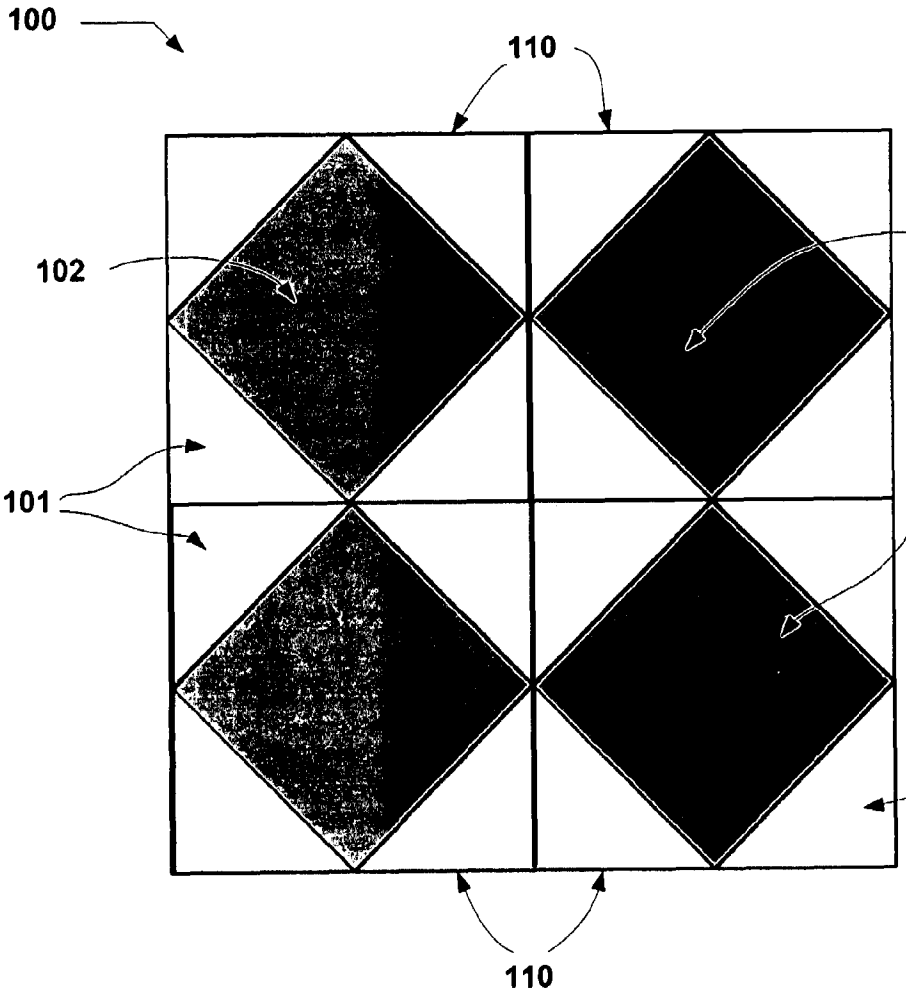
FIG. 1A shows a plan view of a bottom half of embodiments of the present invention as used in a small array.

Refer to FIG. 1A showing a rectangular array 100 of four abutting units 110 each comprising a bottom section 101 and a smaller raised top section 102 comprising an integral part of a unit 110. The units 110 may be top and bottom portions of what are termed "pavers" in the construction industry. The units 110 may be constructed of moldable materials such as Portland cement and its variations, any of a variety of plastics, fiberglass, steel, carbon or KEVLAR® fibers (para-aramids), and combinations of these. The two sections 101, 102 may be formed in a mold as a single entity such that they are not individual parts that may be separated. In the embodiment shown in FIG. 1A, the perimeter of the top section 102 is defined by drawing a line from the middle of a side of the bottom section 101 diagonally across to the middle of an adjacent side of the bottom section 101 and continuing around the sides until the shape of the top section 102 is obtained, as seen in the top (plan) view of FIG. 1A. In one embodiment of the present invention, all such units 110 are identical and symmetrical with respect to top 102 and bottom 101 sections. The symmetry enables the use of like units 110 by inverting an array 100 of units 110 over an un-inverted array 100 of units 110 such that each of the top sections 102 mate in the space created in the un-inverted array 100 where four corners of the units 110 of the un-inverted array 100 come together.

Refer to FIG. 1B, a perspective view of an employed unit 110 shown in a top view in the array 100 in FIG. 1A. This unit 110 is essentially a "small box-on-large box" arrangement with the top section (small box) 102 being arranged so that each of its corners are at the center of the sides of the bottom section (large box) 101, resulting in a small box having sides in the plane parallel to the bottom section (large box) of approximately 0.707 that of the sides of the bottom section 101. Each of the sections 101, 102 is square in the plane at which they contact and set at approximately 45° with respect to each other in that plane. The thickness, $t_1$ and $t_2$, of each of the employed sections 101, 102, respectively is chosen according to structural and esthetic requirements of the user and need not be the same for each section 101, 102.

Figure 2:
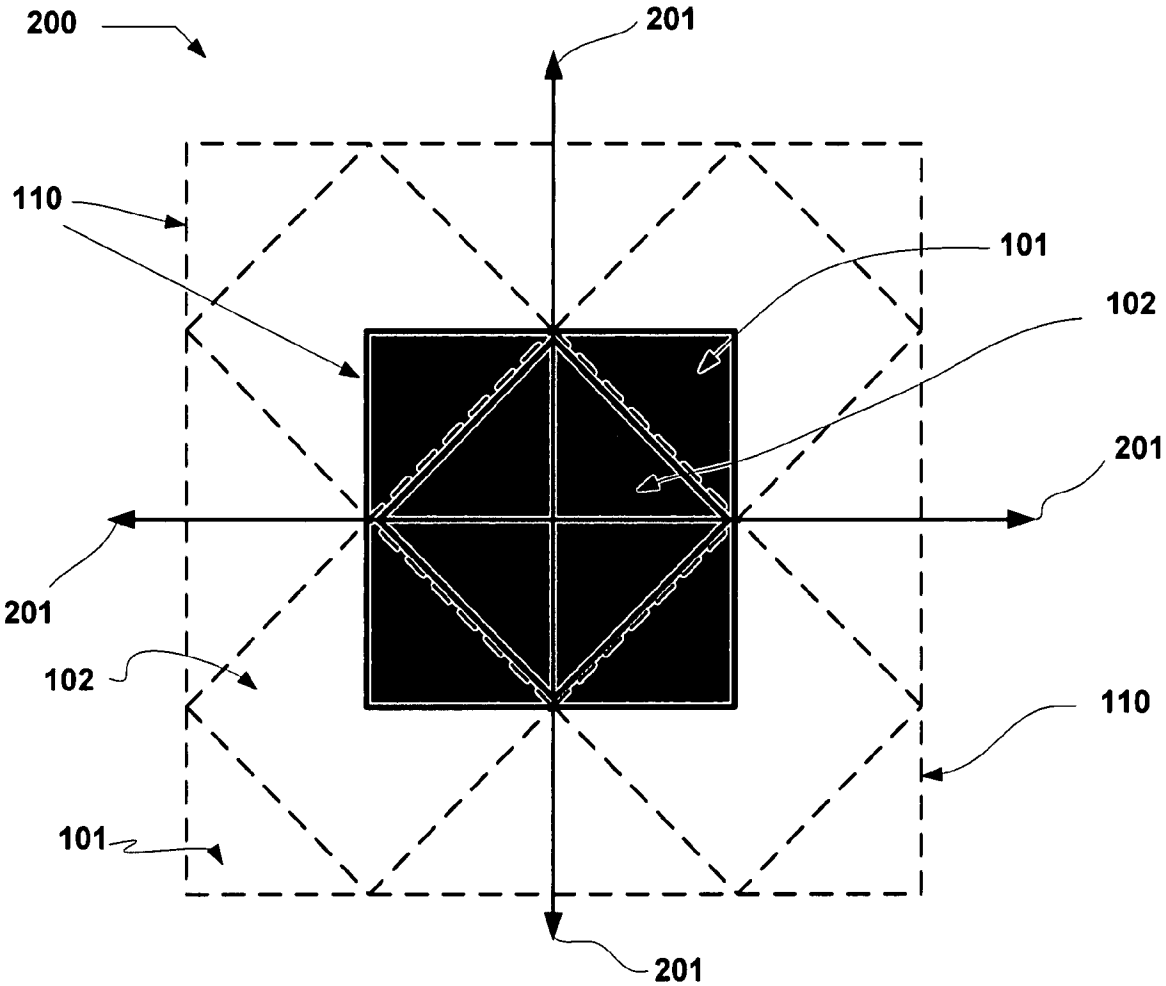
FIG. 2 depicts how the individual unit of FIG. 1B is inverted onto the array of FIG. 1A to effect an embodiment of the present invention.

Refer to FIG. 2. For clarity, an employed single inverted unit 110 is shown as a shaded area over the array 100 of FIG. 1A in a configuration 200 that highlights the "interlocking" feature of the present invention. The dark shaded portion represents a top section 102 for the inverted unit 110. The employed un-inverted array 100 of FIG. 1A is shown in FIG. 2 with a perimeter of dashed lines since this un-inverted portion will not be visible in any installation of this embodiment of the present invention, being covered by inverted units 110 that will be placed outwardly in the direction of the arrows 201. The interlocking occurs at each intersection of the corners of the un-inverted units 110. At the edges of an intended installation of multiple employed arrays 100, the inverted units 110 may be cut in half diagonally to make a smooth edge that matches the edges of the un-inverted array 100 on bottom. Alternatively, "half-units" (not shown separately) may be molded at the factory for forming portions of the edges of installations (e.g., pathways or thoroughfares).

Figure 3:
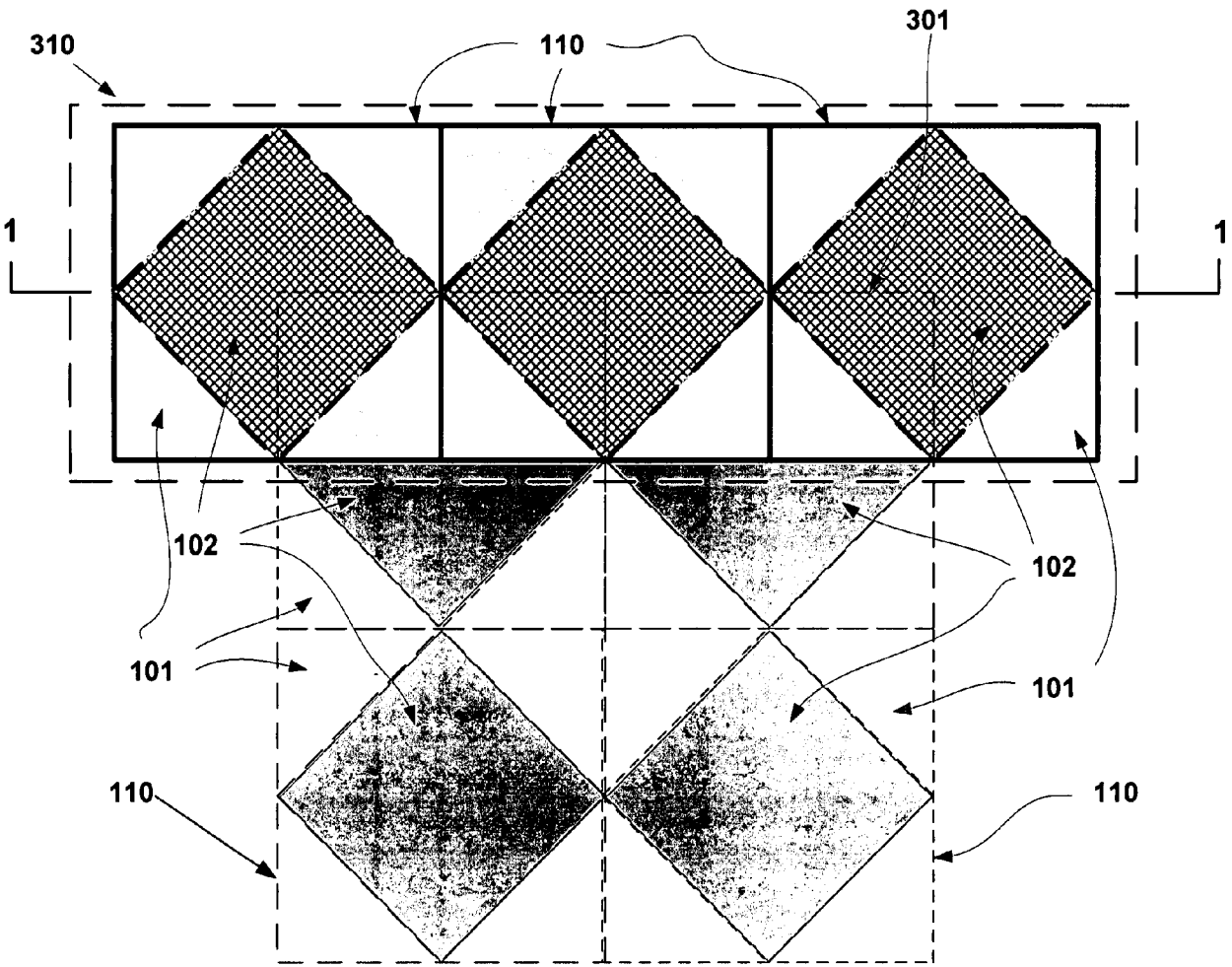
FIG. 3 depicts a top view of three interlocking units inverted over one edge of the array of FIG. 1A as used in an embodiment of the present invention.
Figure 4:
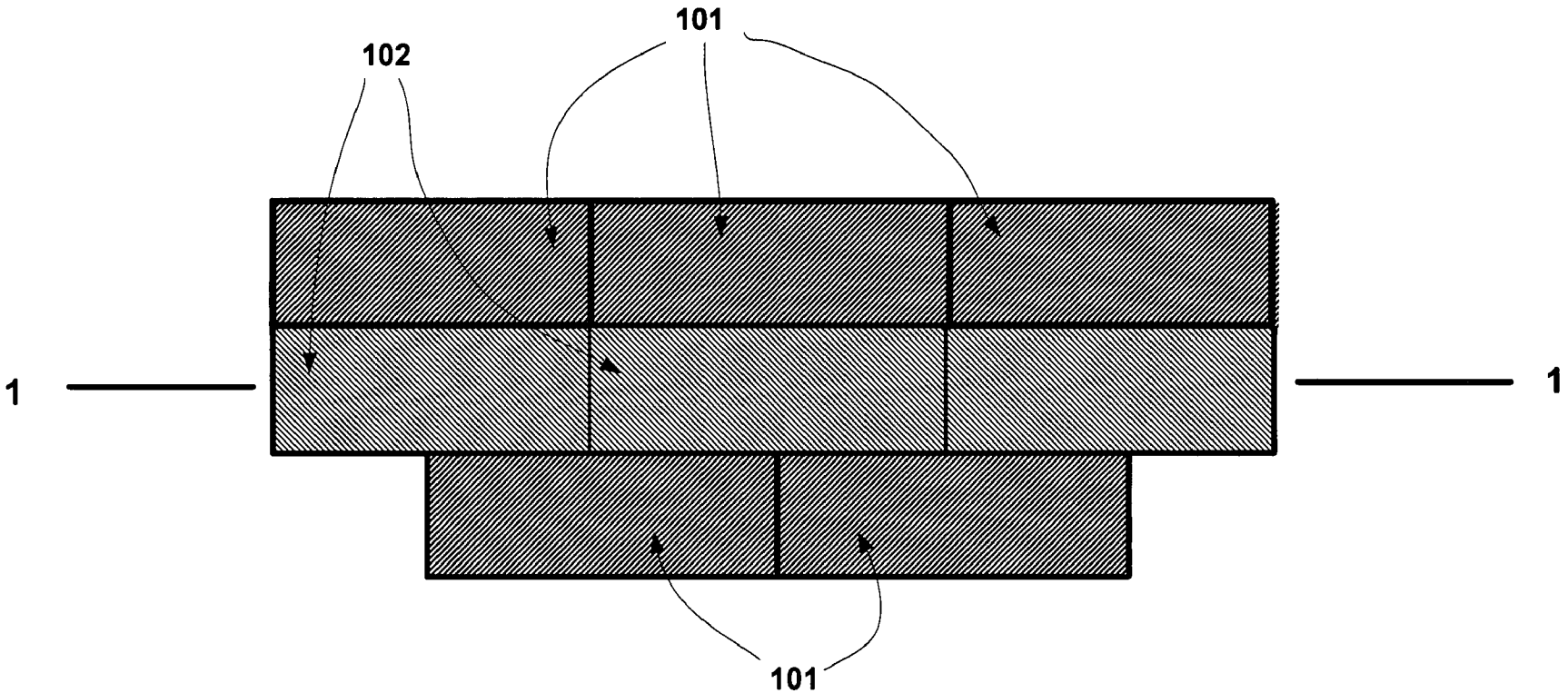
FIG. 4 shows a side view of the relationship of vertically interlocking units of FIG. 1B, showing the edge of the array of FIG. 1A through 1-1 of FIG. 3.

Refer to FIGS. 3 and 4. A configuration 310 of three employed inverted abutting units 110 is placed over an edge 301 of the employed array 100 of FIG. 1A to further illustrate the interlocking feature of an embodiment of the present invention. An end (edge) view of the resultant configuration as taken with a vertical cut through 1-1 of FIG. 3 is shown in FIG. 4. The "half-squares" of the employed top sections 102 cover the intersection between the two employed abutting un-inverted units 110 below the edge insuring a "double thickness" of coverage above each intersection of the un-inverted units 110. Conversely, where the employed inverted units 110 abut is at the middle of one of the un-inverted units.

Figure 5:
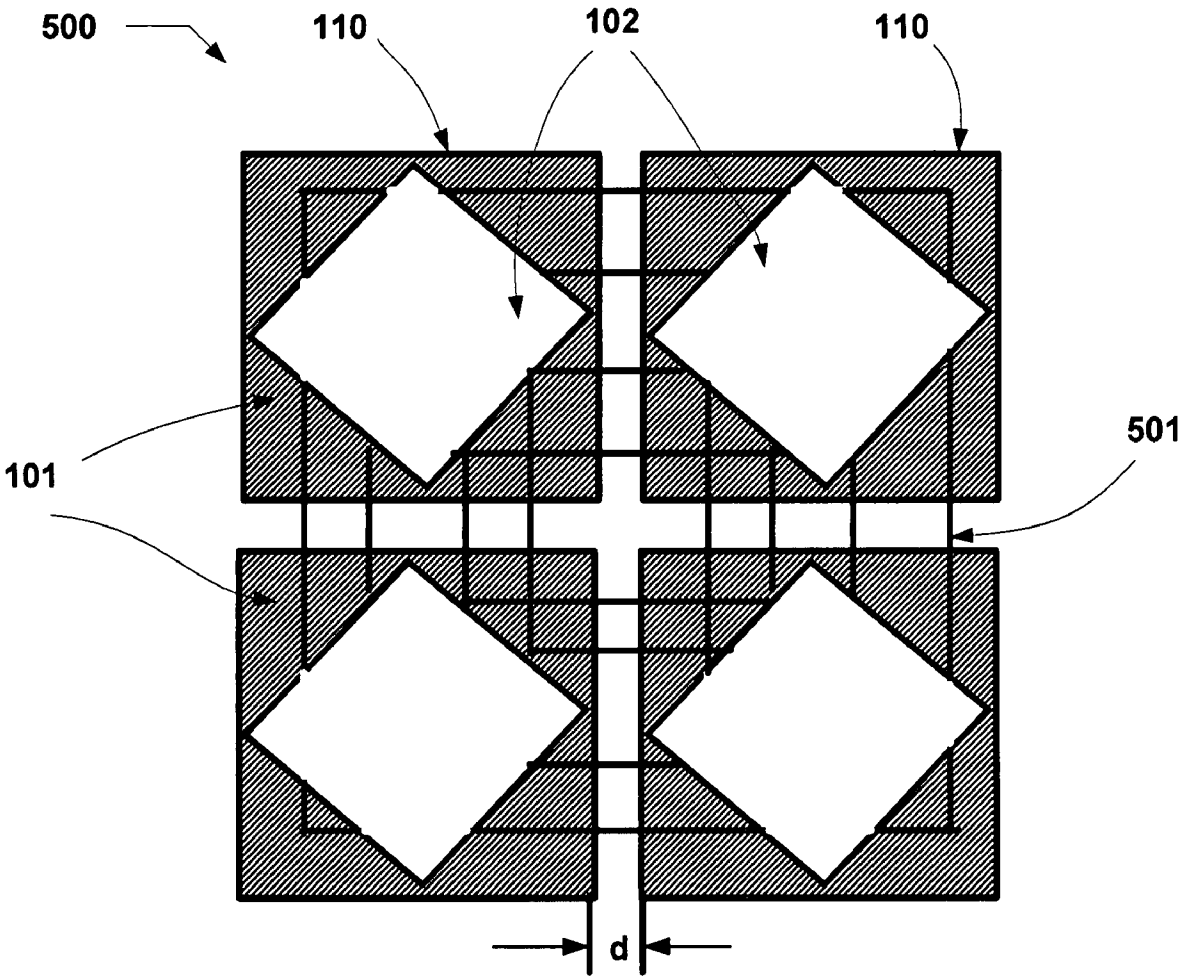
FIG. 5 shows the array of FIG. 1A with a connecting means embedded therein.

Refer to FIG. 5. In one embodiment of the present invention an employed means 501 for connecting together an employed small array 100 of units 110, such as a web of perforated fabric or a wire mesh of metal or suitable roving, is provided in a configuration 500 for ease in placing and maintaining spacing of the units 110 should one wish to make a permanent installation with mortar and grouting between employed units 110. The spacing, d, may be adjusted to accommodate performance and esthetic requirements of the user.

Figure 6:
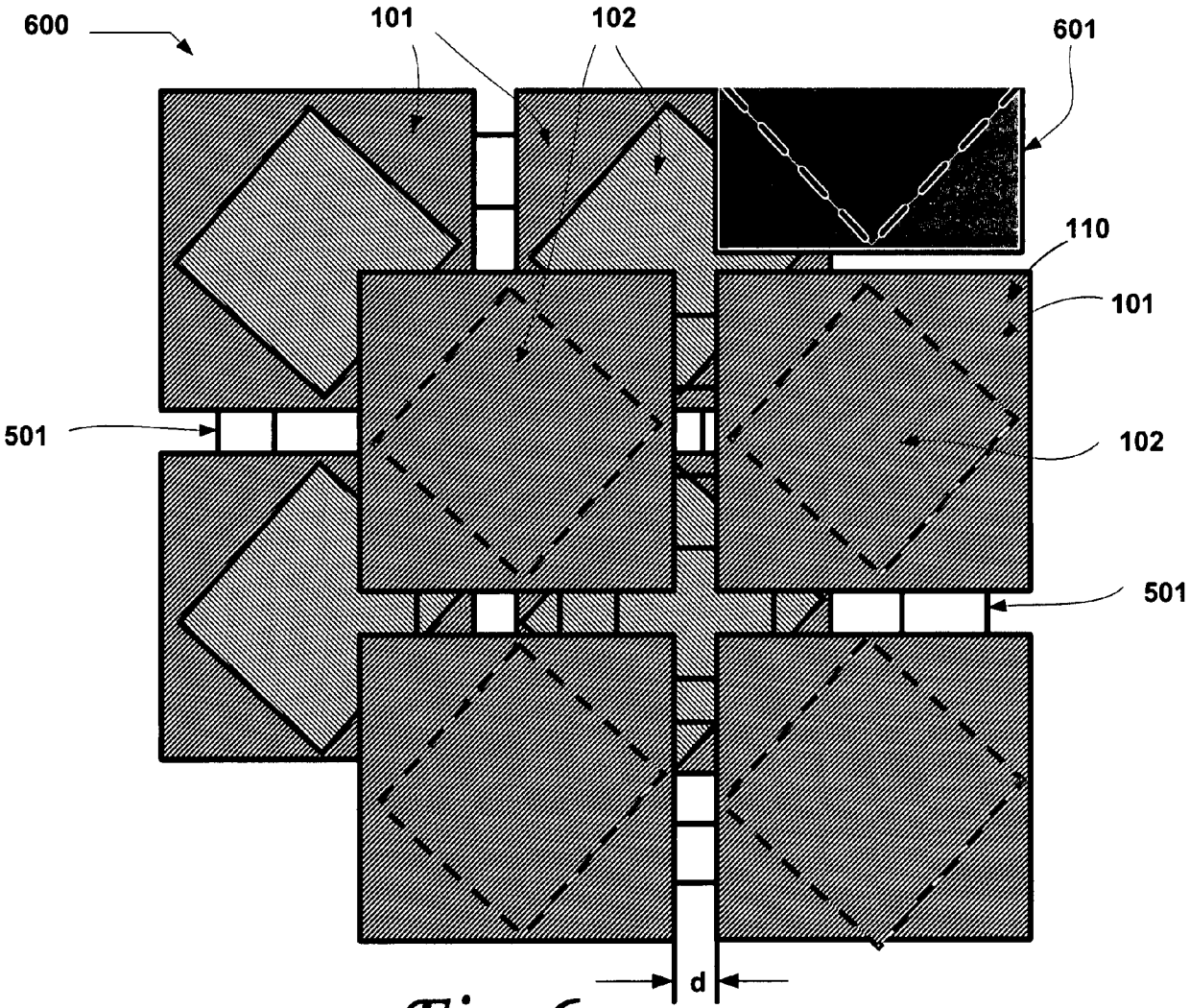
FIG. 6 shows how staggering patterns of the array of FIG. 5 permits interlocking of inverted arrays over un-inverted arrays to effect an embodiment of the present invention.

FIG. 6 shows how staggering the pattern of employed inverted units 110 over employed un-inverted units 110 enables interlocking of the configuration 600 and keeps the units 110 from moving laterally with respect to each other. Thus, the units 110 may be kept together without having to manually attach them to each other, forming a two-layered configuration that may be used for such applications as a pathway, a thoroughfare, a ford, or for stabilizing embankments. For a permanent arrangement, embodiments of the present invention may be provided with a spacing to enable mortar or grout to be placed between neighboring units 110, although they may be useful as installed with only the mechanical interlocking described above. Since individual units 110 cannot be lifted from an installation, it is difficult for vandals to damage the installation by removing units 110. For illustrative purposes, FIG. 6 also shows a single "half-block" 601 as it may be used on an edge of a pathway or pavement.

Figure 7:
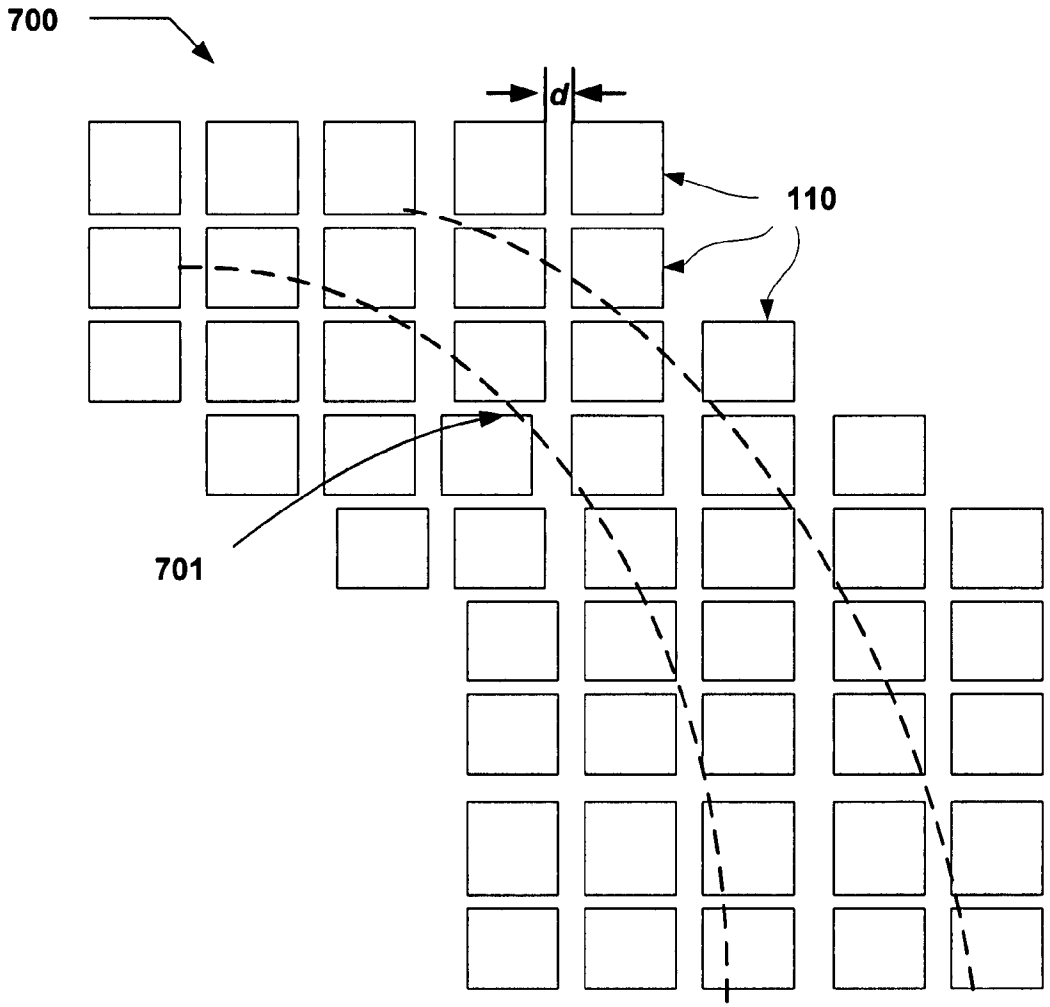
FIG. 7 illustrates a way to change direction of a pathway using top portions of the arrays of FIG. 5 for illustrative purposes only.

Refer to FIG. 7, a simplified representation of the employed units 110 of FIG. 1A as arranged in a manner that enables changing direction to establish a desired pathway 701 that results in the configuration 700. The representation of FIG. 7 is illustrative only, demonstrating that pathways may be made in various configurations enabling changing of direction. For illustrative purposes, FIG. 6 shows a single "half-block" 601 as it may be used on an edge of a pathway to provide a smooth edge to the configuration 700. FIG. 7 is for illustrative purposes only and depicts only the inverted units 110 with the un-inverted units 110 implied as being installed under the inverted units 110.

The employed units 110 may be manufactured in a variety of ways. For example, in one embodiment, bottom sections 101 may be made by filling a first mold or form with a self-hardening mixture such as a Portland cement-based concrete. A connecting means 501, such as web-perforated fabric or metal wire mesh, may be placed over the uncured mixture in the first form and a second form placed over the connecting means 501 to establish the top section 102. An additional layer of mixture is cast over the connecting means 501 such that the second mixture bonds to the first mixture through perforations in the connecting means 501.

A second way of manufacturing employed units 110 is to pre-cast the top 102 and bottom 101 sections and bond or attach them to opposite sides of the connecting means 501.

It is obvious that many modifications and variations of the present invention are possible in light of the above teachings. The basis for getting the employed inverted and un-inverted units 110 to interlock is to use a "regular tessellation" on each of the top and bottom surfaces of the unit 110. The "large box-small turned box" combination of an embodiment of the present invention is two square tessellations 101, 102 with the smaller "box" 102 tessellation on the top of the "layer" of units 110 placed on the bottom and rotated 45 degrees with a grid spacing, or side length, that is 0.707 times that of the larger "box" 101 tessellation. Another usable combination would be triangles, but with triangles the orientation of the base and apex of the triangle is important since adjacent triangles are oriented in opposite directions in a regular tiling of triangles. There are exactly three regular tessellations composed of regular polygons tiling a plane. They are hexagons, squares and triangles.

Figure 8:
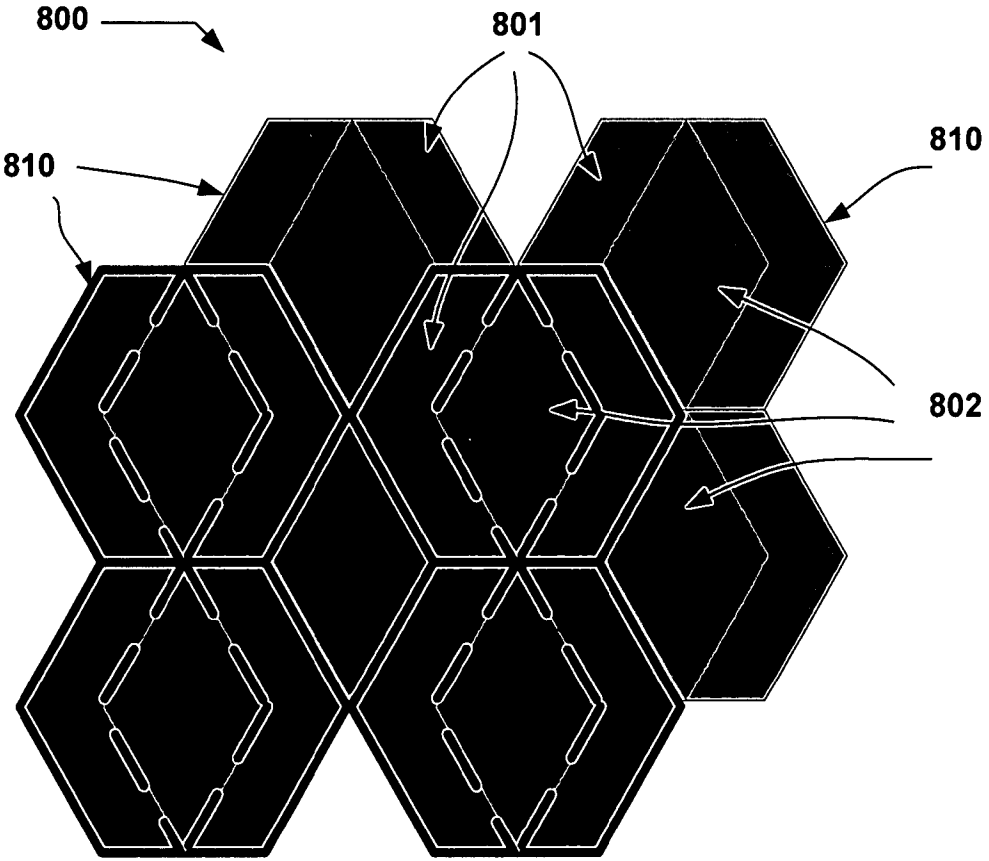
FIG. 8 depicts an alternative configuration using hexagon and diamond shapes to effect an embodiment of the present invention.

Refer to FIG. 8 for an example of hexagon sections 810 employed in an array 800. The bottom section 801 of this array is a hexagon while the top section 802 is a symmetric "diamond" with the long axis of the diamond-shaped top section 802 extending in a line joining the center of two parallel sides of the hexagon of the bottom section 801 and the short axis of the diamond-shaped top section 802 chosen to be the same width as a side of the hexagon-shaped bottom section 802. The employed array 800 of hexagon-shaped units 810 is also amenable to connection of individual units in small arrays, using a mesh or fabric, such as the four-unit array 500 of FIG. 5. These small connected arrays, such as array 500 of FIG. 5, may be connected with or without spacing, d, for mortar or grouting. Unlike the "small box-large box" arrangement of FIG. 1, the "interlocking" section, i.e., the diamond-shaped top section 802 of the bottom layer of the hexagon array 800, is exposed in the top layer of the array 800. Thus, the hexagon array 800 may be chosen for other reasons, such as esthetics.

Figure 9:
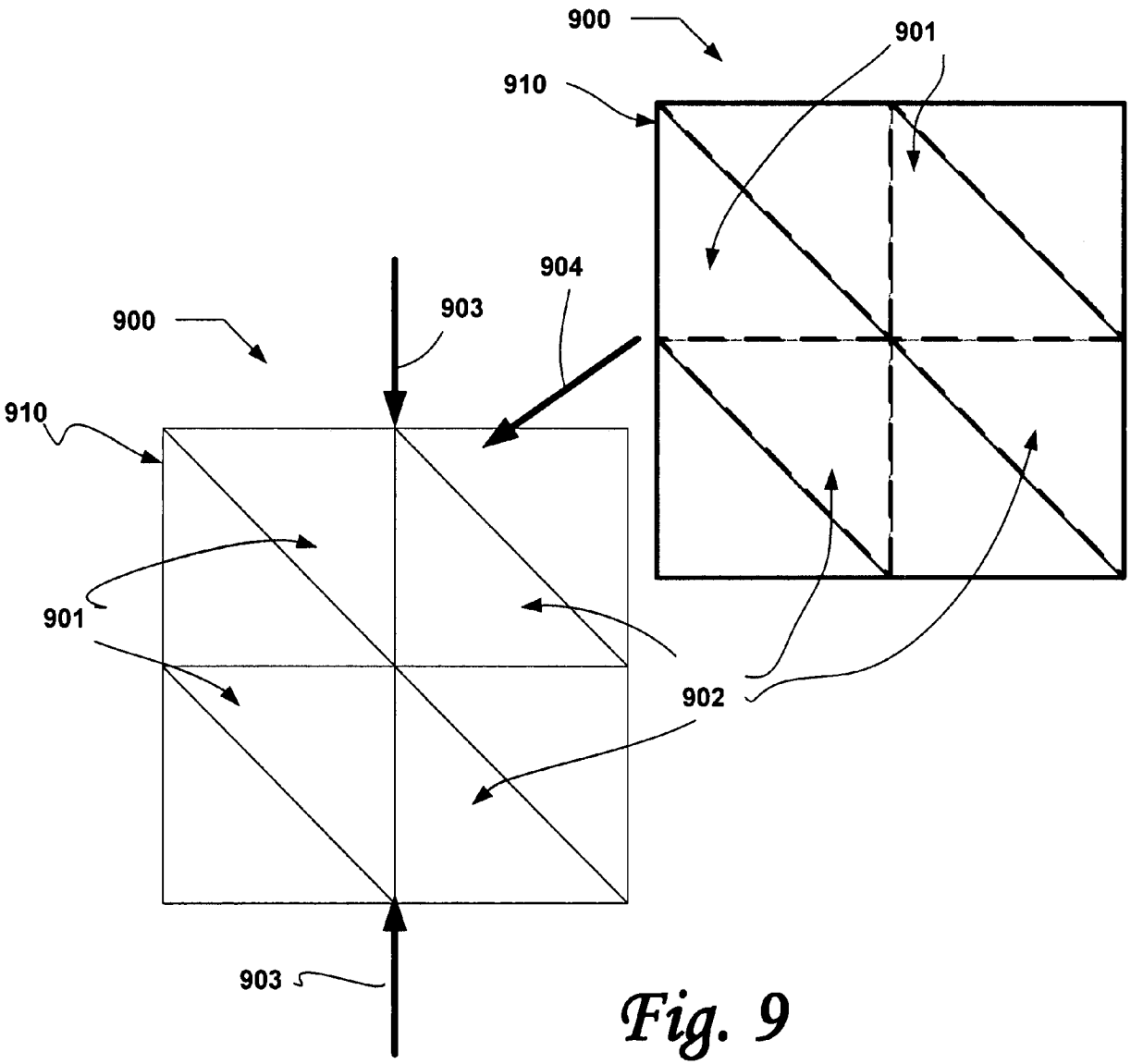
FIG. 9 illustrates an alternative configuration using squares and right triangle shapes to effect an embodiment of the present invention.

Refer to FIG. 9. A configuration involves overlapping employed units 910 that are squares with an employed raised right triangle 902 covering half of one side of each of the units 910, leaving a like right triangle 901 that is not raised on the other half of that side of the unit 910. The configuration of FIG. 9 may consist of employed arrays 900 of individual units 910 each having one raised right triangle section 902 on one side or, alternatively rather than having four individual units 910 making an array 900, a single large square may be fabricated as the array 900 with four raised right triangles 902 formed on the single large square comprising the array 900. This alternative "large square" array 900 with four integral raised right triangles 902 on one side would have the benefit of not needing a mesh or other means to hold together the units 910 and would eliminate four seams, two of which are shown between the arrows 903 so that overlapping inverted arrays 900 each would have fewer portions where seams overlapped as compared to using individual units 910, each with only one raised triangle 902. To minimize the number of seams exposed, an inverted four-unit configuration 900 could overlap a single small square as indicated by the arrow 904 or overlap half of a bottom layer as indicated along the line represented by the arrow 903.

The easiest interlocking units 110, 810, 910 to fabricate and install are those involving different sized squares, as described above for the array of FIGS. 1A and 5, and a combination of squares with raised right triangles on half of one side as depicted in FIG. 9. The most practical interlocking system may be the small box-large box combination of FIGS. 1A and 5. It is therefore to be understood that within the scope of the appended claims, the invention may be practiced otherwise than as described.

Accordingly, all such modifications are intended to be included within the scope of this invention as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

The abstract is provided to comply with the rules requiring an abstract, which will allow a searcher to quickly ascertain the subject matter of the technical disclosure of any patent issued from this disclosure. 37 CFR § 1.72(b). Any advantages and benefits described may not apply to all embodiments of the invention.

I claim:

1. A method for covering a pre-specified area with vertically interlocking pavers, comprising:

leveling said pre-specified area;

providing components for a pre-specified array of said pavers, said components comprising:

a first section having first sides parallel to a first plane containing a first bearing surface and a first thickness in a second plane orthogonal to said first plane, said first thickness of a dimension less than that of any of said first sides; and a second section having second sides parallel to both said first plane and a second plane containing a second bearing surface, said second plane parallel to said first plane, said second section contacting said first section uniformly along a part of said first plane, said second section oriented to said first section such that said second sides are contained entirely within the perimeter formed by said first sides;

arranging four said components in said pre-specified array in a first plane parallel to said leveled area such that each said component is arranged in a plane to abut a first said component along a first axis in said plane and a second said component along a second axis in said plane, said second axis orthogonal to said first axis;

arranging additional said pre-specified arrays abutting one to another to cover said pre-specified area in a first configuration of arrays;

inverting a second configuration of said pre-specified arrays over said first configuration such that said second configuration interlocks vertically with said first configuration; and adding partial said components for forming finished edges of said interlocked configurations.

2. The method of claim 1 employing said components in which said first sides form a first square, said second sides form a second square set at about a 45° angle to said first square, said second square having sides of a length approximately 0.707 that of said first sides.

3. The method of claim 1 employing said components in which said first sides form a hexagon and said second sides form a diamond with the long axis of said diamond extending in a line joining the center of two parallel sides of said hexagon and the short axis of said diamond chosen to be the same width as that formed by two parallel said first sides of said hexagon.

4. The method of claim 1 employing said components in which said first sides form a square and said second sides form a single right triangle along two adjacent sides of said square.

5. The method of claim 1 employing said components in which said first and second sections are fabricated such that said first and second sections are incorporated inseparably in said components.

6. The method of claim 5 fabricating said components with a layer of compressible material between said first and second sections.

7. The method of claim 6 selecting said compressible material from the group consisting of:

a mesh, a fabric, roving, a web-perforated fabric, a wire mesh, an elastomer, and combinations thereof.

8. The method of claim 1 employing said components in which at least one of said first and second sections is formed of a lamination of at least two layers.

9. The method of claim 8 employing said components in which at least one of said layers is made of a material flexible under compression.

10. A method of fabricating components for a vertically interlocking configuration of pavers, comprising:

providing a first mold to form a first section of said components, said first section comprising:

first sides parallel to a first plane containing a first bearing surface and a first thickness in a second plane orthogonal to said first plane, said first thickness of a dimension less than that of any of said first sides;

providing a second mold to form a second section of said components, said second section comprising:

second sides parallel to both said first plane and a second plane containing a second bearing surface, said second plane parallel to said first plane, said second section contacting said first section uniformly along a part of said first plane, said second section oriented to said first section such that said second sides are contained entirely within the perimeter formed by said first sides;

pouring a fluid mixture of a first material into said first mold to be at least partially hardened in said mold as said first section;

permitting said first mixture to at least partially harden in said first mold;

placing said second mold over said first at least partially hardened mixture in a pre-specified orientation;

pouring a fluid mixture of a second material into said second mold to be hardened in said mold;

upon hardening of said first and second mixtures to a pre-specified level, removing said molds, and trimming said components as necessary.

11. The method of fabricating of claim 10 further comprising arranging at least four said components in a pre-specified array and adding a connecting means over at least a portion of each said first sections of each said four components before placing said second mold.

12. The method of fabrication of claim 11, the connecting means comprising material selected from the group consisting of: a mesh, a fabric, roving, a web-perforated fabric, a wire mesh, an elastomer, and combinations thereof.

13. The method of fabrication of claim 11 employing approximately identical material for said first and second sections.

14. The method of fabrication of claim 13 employing a mixture containing at least some Portland cement as said identical material.

15. The method of fabrication of claim 11 employing materials of differing composition for said first and second sections.

16. The method of fabrication of claim 15 employing layers of materials of differing composition for at least one of said first and second sections such that at least one of said first and second sections is a laminate of at least two said layers.

17. The method of fabrication of claim 16 employing at least one material flexible in compression as at least one said layer.

* * * * *